United States Patent [19]

Gassner et al.

[11] 3,964,324

[45] June 22, 1976

[54] FRICTION ROLLERS FOR TWIST TUBES IN FALSE-TWISTING APPARATUS

[75] Inventors: Hans Gassner, Schweinfurt; Manfred Kress, Grafenrheinfeld, both of Germany

[73] Assignee: Kugelfischer Georg Schafer & Co., Schweinfurt, Germany

[22] Filed: Apr. 3, 1975

[21] Appl. No.: 564,864

[30] Foreign Application Priority Data

Apr. 10, 1974 Germany ..... 2417627

[52] U.S. Cl. ..... 74/215; 74/206; 57/77.45; 57/103

[51] Int. Cl.[2] ..... D01H 7/92; B21B 27/00

[58] Field of Search ..... 74/206, 214, 215, 229, 74/230.5; 57/77.45, 103

[56] References Cited

UNITED STATES PATENTS 3,613,467 10/1971 Lee ..... 74/215

*Primary Examiner*—Samuel Scott
*Assistant Examiner*—A. Russell Burke
*Attorney, Agent, or Firm*—Edward R. Weingram

[57] ABSTRACT

A friction roller for rotating twist tubes in twisting apparatus in which the friction ring is protected from contact with ambient oil by means of a protective coating and a slinger edge disposed on at least one side of the friction ring. The protective layer may be a protective ring which may be integral with the roller or it may be a protective layer of lacquer applied to the friction ring. The layer protects the friction ring from the spinning oil and the slinger edge acts to fling off by centrifugal force that oil which collects around the periphery of the friction roller so that the running surface of the friction ring remains unaffected.

In one embodiment the slinger edge projects radially beyond the running surface of the friction ring and there is a peripheral groove on the associated twist tube which cooperates with the slinger edge in the manner of a labyrinth seal, which increases the protection against adverse influences from the spinning oil.

14 Claims, 7 Drawing Figures

FRICTION ROLLERS FOR TWIST TUBES IN FALSE-TWISTING APPARATUS

BACKGROUND OF THE INVENTION

1. Field of the Invention.

This invention relates to false-twisting apparatus and more particularly to friction rollers for driving high-speed twist tubes in false-twisting apparatus.

2. Description of the Prior Art.

False-twisting apparatus often uses friction rollers to twist a twist tube at speeds of up to 800,000 r.p.m. for example, by engaging the rollers against the twist tube. The friction rollers rotate at up to 40,000 r.p.m. and comprise a carrier of an inelastic material with a radial flange around the periphery of which a friction ring of an elastic synthetic resin material is secured. Such rollers are described in German Patent Specification No. 1,525,149. At least one of the rollers is driven. The twist tube is held in position against the rollers, by for example magnets.

A thread runs at a high speed through the twist tube. It passes around a twist pin in the tube either positioned at one end or at the midpoint of the tube. It is particularly advantageous to arrange the twist pin in the central region of the passage through the twist tube when the twist tube is to be rotated at extremely high speeds. In order to facilitate threading of the thread around the pin the tube has at least one transverse opening in the region of the pin.

In the false twisting process the thread to be false twisted runs over the surface of the twist pin under a certain amount of tension and is thereby squeezed so that the spinning oil that clings to the thread is removed or, where the thread is made up of a number of filaments, squeezed out of the thread. The oil is flung out through the transverse opening or openings in the twist tube as a result of the high centrifugal forces that are present, and it coats the adjacent parts of the associated false-twisting apparatus, in particular the regions of the friction rollers that face the twist tube pin.

This is a disadvantage insofar as the spinning oils, in particular the oils used im crimping, contain components which attack the friction rings of the rollers, which rings, because of the high loading, are made of a special material, for example polyurethane of predetermined hardness. The oil coating on the rings is particularly troublesome since it is important that the friction rings remain in a clean condition to promote smooth running of the twist tubes up to the highest possible speeds.

The coating of spinning oil causes the friction rings to lose their good running characteristics and to swell up and wear within a relatively short time. The idea of sucking away the mist or coating of spinning oil to avoid these problems is not practicable due to the lack of space and also because it is technically complicated and expensive.

SUMMARY OF THE INVENTION

In order to overcome the problems of the prior art, the present invention provides a friction roller for rotating twist tubes in twisting apparatus in which the friction ring is protected from contact with ambient oil by means of a protectve coating and a slinger edge disposed on at least one side of the friction ring. The protective layer may be a protective ring which may be integral with the roller or it may be a protective layer of lacquer applied to the friction ring. The layer protects the friction ring from the spinning oil and the slinger edge acts to fling off by centrifugal force that oil which collects around the periphery of the friction roller, so that the running surface of the friction ring remains unaffected.

In one embodiment the slinger edge projects radially beyond the running surface of the friction ring and there is a peripheral groove on the associated twist tube which cooperates with the slinger edge in the manner of a labyrinth seal, which increases the protection against adverse influences from the spinning oil.

Accordingly, it is an object of the present invention to remove and/or prevent the depositing of oil on the friction rings of rollers.

Another object of the present invention is to reduce the adverse effects on the friction rings caused by spinning oil from the threads.

Another object of the present invention is to significantly reduce the slippage between the driving friction roller and the associated twist tube.

Still another object of the present invention is to provide a roller having a protective layer and slinger edges positioned on at least that side of the friction ring on which the twist pin of the associated twist tube lies.

Yet another object of the present invention is to provide a roller for false-twisting apparatus which is relatively unaffected by ambient twisting oils.

It is a further object of the present invention to provide a roller for false-twisting apparatus which has running rings that are relatively unexposed to ambient twisting oils.

An additional object of the present invention is to provide a roller for false-twisting apparatus which has extended service life and reliability of operation.

Other objects and advantages will be apparent from the following description of several embodiments of the invention, and the novel features will be particularly pointed out hereinafter in connection with the appended claims.

DESCRIPTION OF PREFERRED EMBODIMENTS

Figure 1:
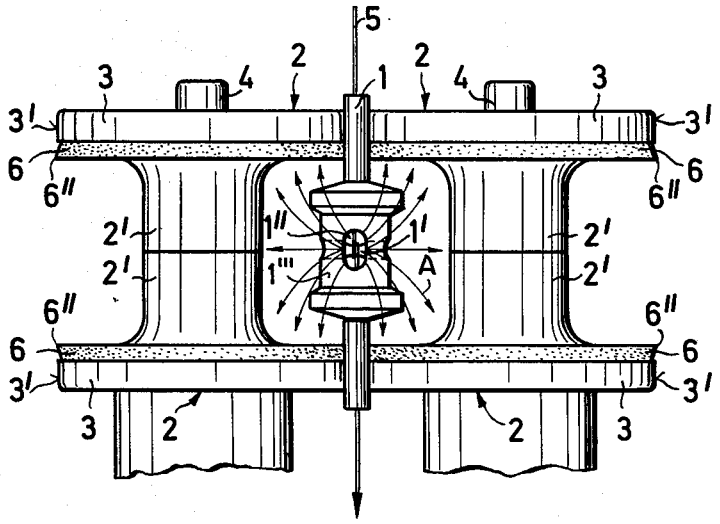
FIG. 1 is a side view of two mutually parallel pairs of friction rollers built in accordance with the teachings of the present invention, operatively associated with a twist tube.

A twist tube 1 is shown in FIG. 1 with a central twist pin 1′ and two co-axial transverse openings 1″ in the housing, 1‴ for the twist pin 1′. The openings 1′ form a passage extending transversely with respect to the pin 1′for threading a thread 5 to be false-twisted around the pin 1'. The twist tube 1 is urged by a magnet (not shown) against two mutually parallel pairs of friction rollers 2. The twist tube 1 abuts the running surface 3' of the friction ring 3 of each roller 2. The two rollers 2 of each pair are mounted on a shaft 4 and the two shafts 4 are parallel to each other. Shaft 4 is driven by drive means, not shown, and its friction rollers 2 drive the twist tube 1 which in turn cause the rollers 2 on the other shaft 4 to rotate.

The thread 5 to be false-twisted runs at high speed through the twist tube 1 and passes around the twist pin 1'. The spinning oil normally adhering to the thread is consequently thrown off, or, in the case of a thread made up of a number of filaments, the oil is squeezed out. Due to the centrifugal forces arising through the high rotational speed of the apparatus, the oil is flung out through the openings 1'' in the form of a mist, as indicated by the arrows A in FIG. 1. Each friction roller 2 is provided on that face of the friction ring 3 which faces towards the twist pin 1' of the twist tube 1 with a protective coating 6 of material resistant to spinning oil and an oil slinger edge 6'', as indicated only diagrammatically in FIG. 1.

Figure 2:
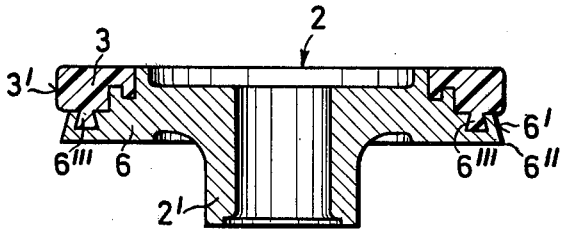
FIG. 2 shows a longitudinal section through a friction roller built in accordance with the teachings of the present invention.

As shown in FIG. 2, the protective layer is formed by a ring 6 which is integral with the carrier 2' of the friction roller 2. The ring 6 is provided with a frustoconical surface 6'. The ring 6 and the carrier 2' may be made of aluminum or an aluminum alloy or a plastics material for example, while the friction ring 3 may be made for example of polyurethane of suitable harness. The protective ring 6 may alternatively be made as a separate component which is joined to the carrier 2'.

The frustoconical peripheral surface 6' widens out in a direction away from the friction ring 3. An oil slinger edge 6'' is formed by the edge between the wider end of the frustoconical peripheral surface and the face of the protective ring 6 which is furthest from the friction ring 3. In this way, not only is most of the mist of spinning oil kept away from the friction ring 3 but also any spinning oil which does reach and collect on the peripheral surface 6' is urged back towards the edge 6'' by centrifugal force and flung off.

The protective ring 6 is provided with an inversely tapered annular groove 6''' into which the friction ring material is cast so that positive anchoring between the friction ring 3 and the associated carrier 2' is obtained through the protective ring 6. The friction ring 3 shown in the embodiment in FIG. 2 is thus strengthened and in use displays stablility and accuracy of shape.

Figure 3:
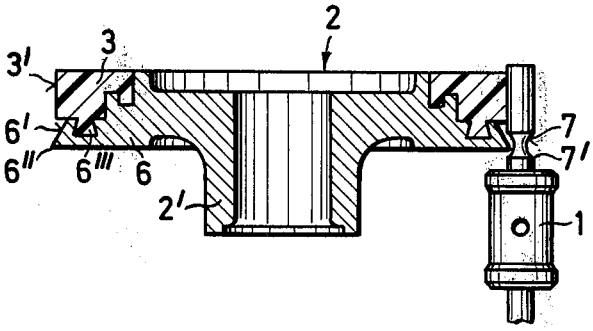
FIG. 3 shows the friction roller operatively associated with a twist tube.

The embodiment shown in FIG. 3 differs from that of FIG. 2 in that the slinger edge 6'' does not lie within an imaginary cylindrical surface having the diameter of the running surface 3' of the friction ring 3. Instead, the frustoconical peripheral surface 6' extends radially beyond the running surface 3' of the friction ring 3 and the slinger edge 6'' lies outside the imaginary cylindrical surface. The associated twist tube 1 has a peripheral groove 7 into which the slinger edge 6'' projects. This achieves a labyrinth seal effect, and provides additional protection of the friction ring 3 over the whole periphery of the roller 2. By giving the flanks 7' of the groove an appropriate conical shape an axial returning action of the spinning oil on the twist tube 1 can also be achieved.

Figure 4:
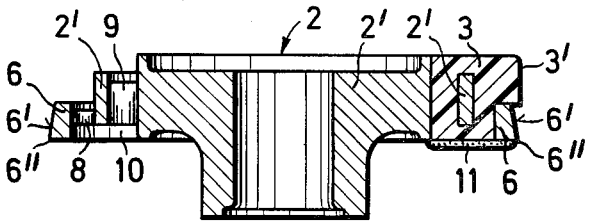
FIG. 4 is a longitudinal section along the line IV—IV in FIG. 5.
Figure 5:
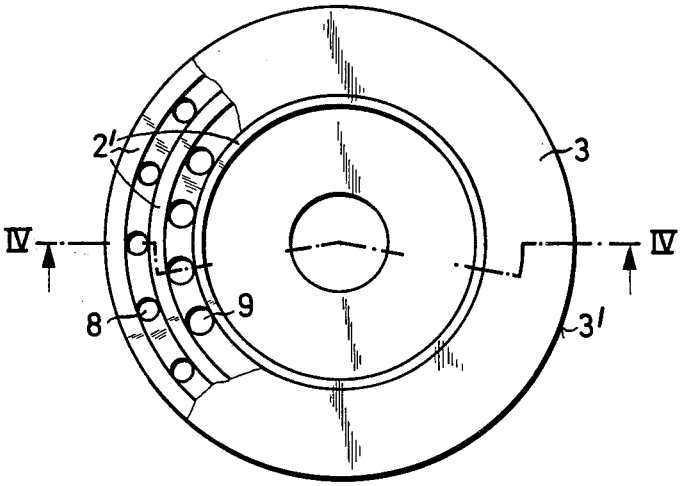
FIG. 5 is a plan view of a friction roller built in accordance with the teachings of the present invention, the friction ring being partially broken away.

In the embodiment shown in FIGS. 4 and 5, the protective ring 6 is integral with the carrier 2' of the friction roller 2. The protective ring 6 has a ring of axial holes 8 in it and a second ring of axial holes 9 are formed in the carrier on a smaller pitch circle than holes 8. The holes 9 in the carrier 2' are longer than the holes 8 in the protective ring 6 and extend to the region of the running part of the friction ring as can be seen in the righthand half of FIG. 4. As shown in FIG. 5, the two rings of holes 8 and 9 are mutually displaced in a peripheral direction, so that each hole 8 or 9 of one ring lies between two adjacent holes 9 or 8 of the other ring. As can be seen in the lefthand half of FIG. 4, the axial holes 8 and 9 of the two concentric rings open into a common circumferential groove 10 extending from the face of the carrier 2' and the protective ring 6 having the slinger edge 6''.

As will be seen in the righthand half of FIG. 4, the friction ring material is embedded in the axial holes 8 and 9 and in the circumferential groove 10. The surface of the friction ring material in the mouth of the circumferential groove 10 is provided with a coating 11 of protective lacquer. The friction ring 3 is thus protected in the region of the mouth of the circumferential groove 10, and protection of the running surface 3' of the friction ring is provided by the protective ring 6 with the conical peripheral surface 6' and the slinger edge 6'', which is arranged in the same way as in the embodiment shown in FIGS. 2 or 3.

Figure 6:
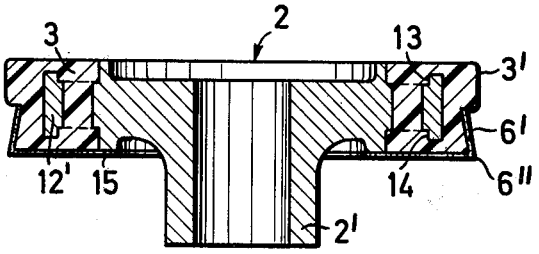
FIG. 6 is a longitudinal section along line VI—VI in FIG. 7.
Figure 7:
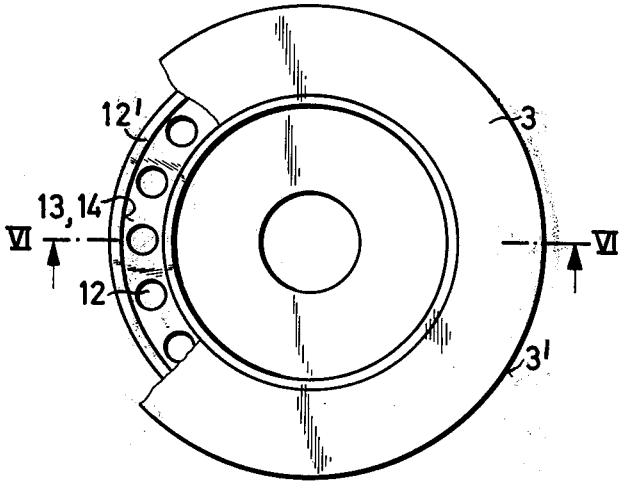
FIG. 7 is a plan view of another friction roller built in accordance with the teachings of the present invention, the friction ring being partially broken away.

In the embodiment shown in FIGS. 6 and 7, the carrier 2' of non-elastic plastics material, or aluminum or an aluminum alloy has a radial annular flange 12' with a ring of axial holes 12 and an annular shoulder 13, 14 outside the ring of holes 12 on both faces. The friction ring 3, made of a resilient plastics material, such as for example polyurethane of suitable hardness, is molded onto the carrier 2', preferably under pressure. The fluid synthetic resin penetrates into the holes 12 during the molding process and thereby anchors the friction ring 3 securely and effectively to the carrier 2'. The inwardly directed annular shoulders 13 and 14 engaged by the friction ring 3 hold the ring 3 onto the carrier 2' during rotation of the friction roller at extremely high operating speeds such as for example 40,000 r.p.m., against the action of the resulting high centrifugal forces in such a way that the ring maintains an exact cylindrical running surface 3'.

At one side of the running surface 3' the friction ring 3 is formed with a frustoconical peripheral surface 6', which widens away from the running surface 3'. The wider end of the frustoconical peripheral surface 6' meets the intersecting face of the friction ring 3 at an edge which acts as a slinger edge 6'' like the edge in the embodiments shown in FIGS. 2 and 3. The frustoconical face and said intersecting face of the friction ring are provided with a protective layer of lacquer 15.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. a friction roller for driving a high-speed twist tube in false-twisting apparatus comprising:

a carrier of an inelastic material;

a radial friction ring peripherally securedaround said carrier, and formed from an elastic material; and a protective layer having a slinger edge disposed on at least one side of the friction ring.

2. A friction roller according to claim 1, wherein said protective layer is in the form of a protective ring on one side of said friction ring.

3. A friction roller according to claim 2, wherein the protective ring is formed with a frustoconical peripheral face widening away from the friction ring, and the slinger edge is the edge formed at the wider end of the frustoconical face.

4. A friction roller according to claim 2, in which at least part of the protective ring extends radially beyond the friction ring, and thereby being adapted for coaction with a twist tube in which a peripheral groove is formed to coact with the protective ring.

5. A friction roller according to claim 2, wherein the protective ring and the friction ring are anchored to each other.

6. A friction roller according to claim 5, wherein:

a groove is formed in the face of the protective ring facing the friction ring;

the friction ring being keyed into the groove; and the opposite face of the protective ring ia unbroken.

7. A friction roller according to claim 6, wherein said groove in said protective ring is dovetail shaped.

8. A friction roller according to claim 5, wherein:

said protective ring includes a ring of axial holes formed therein;

the resilient material of the friction ring extends through said axial holes to form a face of resilent material on that side of the protective ring facing away from the friction ring; and a coating of a protective lacquer.

9. A friction roller according to claim 8, further comprising:

a second ring of axial holes formed in the carrier concentric with said ring of holes in said protective ring;

a common groove in that face of the protective ring facing away from the friction ring;

said two rings of holes open into said common groove;

said holes and said groove are filled with the material of the friction ring; and a protective layer of lacquer on the face of the material in the groove.

10. A friction roller according to claim 9, wherein the axial holes in the carrier are longer than the axial holes in the protective ring and extend behind the running face of the friction ring.

11. A friction roller according to claim 9 in which the ring of axial holes in the carrier and the ring of axial holes in the protective ring are mutually displaced so that each hole in one ring lies angularly between the adjacent holes in the other ring.

12. A friction roller according to claim 2 wherein the protective ring and the carrier are integral.

13. A friction roller according to claim 1, wherein the friction ring has a peripheral face comprising:

a running portion;

a second portion alongside said running portion shaped to provide a slinger edge; and further comprising a protective coating of lacquer covering said second portion.

14. A friction roller according to claim 13, wherein said second portion of said peripheral face is frustoconical shaped widening away from said running portion.

* * * * *

UNITED STATES PATENT OFFICE

CERTIFICATE OF CORRECTION

Patent No. 3964324 Dated June 22, 1976

Inventor(s) Hans Gassner and Manfred Kress

It is certified that error appears in the above-identified patent and that said Letters Patent are hereby corrected as shown below:

Column 5, Line 21 change "ia" to --is--

Signed and Sealed this

Third Day of May 1977

[SEAL]

*Attest:*

RUTH C. MASON
*Attesting Officer*

C. MARSHALL DANN
*Commissioner of Patents and Trademarks*